US011217885B2

(12) United States Patent
Kuo et al.

(10) Patent No.: US 11,217,885 B2
(45) Date of Patent: Jan. 4, 2022

(54) SHELL AND WIRELESS DEVICE USING THE SAME

(71) Applicant: Industrial Technology Research Institute, Hsinchu (TW)

(72) Inventors: Fang-Yao Kuo, Taichung (TW); Che-Yang Chiang, Hsinchu (TW); Wen-Chiang Chen, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 16/727,800

(22) Filed: Dec. 26, 2019

(65) Prior Publication Data

US 2021/0151870 A1 May 20, 2021

(30) Foreign Application Priority Data

Nov. 18, 2019 (TW) ..... 108141818

(51) Int. Cl.

| | |
|---|---|
| ***H01Q 1/42*** | (2006.01) |
| ***H01Q 21/00*** | (2006.01) |
| ***H01Q 21/06*** | (2006.01) |
| ***H01Q 1/24*** | (2006.01) |

(52) U.S. Cl.

CPC ..... *H01Q 1/421* (2013.01); *H01Q 1/243* (2013.01); *H01Q 21/005* (2013.01); *H01Q 21/0043* (2013.01); *H01Q 21/065* (2013.01); *H01Q 21/06* (2013.01)

(58) Field of Classification Search

CPC .. H01Q 21/005; H01Q 13/18; H01Q 21/0043; H01Q 1/24; H01Q 1/243; H01Q 1/526; H01Q 21/00; H01Q 23/00

See application file for complete search history.

(56) References Cited

U.S. PATENT DOCUMENTS

| | | | | |
|---|---|---|---|---|
| 8,188,932 | B2 * | 5/2012 | Worl | H01Q 21/064 343/776 |
| 9,667,290 | B2 * | 5/2017 | Ouyang | H01Q 21/0025 |
| 9,685,708 | B2 | 6/2017 | Sonozaki et al. | |
| 10,084,490 | B2 * | 9/2018 | Ouyang | H01Q 1/2266 |
| 10,680,663 | B2 * | 6/2020 | Ouyang | H01Q 1/2266 |
| 2016/0308563 | A1 * | 10/2016 | Ouyang | H04B 1/03 |
| 2017/0110787 | A1 | 4/2017 | Ouyang et al. | |

(Continued)

FOREIGN PATENT DOCUMENTS

| | | |
|---|---|---|
| CN | 105762485 | 7/2016 |
| CN | 206864616 | 1/2018 |
| CN | 206962004 | 2/2018 |

(Continued)

OTHER PUBLICATIONS

"Office Action of Taiwan Counterpart Application", dated Nov. 20, 2020, p. 1-p. 5.

(Continued)

*Primary Examiner* — Vibol Tan
(74) *Attorney, Agent, or Firm* — JCIPRNET

(57) ABSTRACT

A wireless device includes a shell and an array antenna. The shell is configured with a low reflection structure. The array antenna disposed inside the shell, and the low reflection structure is located within a radiation range of the array antenna after beam scanning. The low reflection structure includes a plurality of slots arranged periodically.

11 Claims, 8 Drawing Sheets

(56) References Cited

U.S. PATENT DOCUMENTS

| | | | | |
|---|---|---|---|---|
| 2017/0207524 | A1* | 7/2017 | Cardinali | H01Q 9/42 |
| 2019/0027808 | A1* | 1/2019 | Mow | H04R 1/025 |

FOREIGN PATENT DOCUMENTS

| | | | | |
|---|---|---|---|---|
| CN | 109565118 | | 4/2019 | |
| CN | 109616765 | | 4/2019 | |
| CN | 209298341 | | 8/2019 | |
| TW | I518998 | | 1/2016 | |
| TW | I563899 | | 12/2016 | |
| WO | WO-2020187145 | A1 * | 9/2020 | H01Q 1/24 |

OTHER PUBLICATIONS

"Office Action of Taiwan Counterpart Application", dated Mar. 16, 2021, p. 1-p. 7.

* cited by examiner

3: wireless device
10: shell
11: low reflection structure
20: array antenna
30: electronic component
40: substrate 10: shell
11: low reflection structure
12: non-low reflection structure 11: low reflection structure
20: array antenna

SHELL AND WIRELESS DEVICE USING THE SAME

CROSS-REFERENCE TO RELATED APPLICATION

This application claims the priority benefit of Taiwan application no. 108141818, filed on Nov. 18, 2019. The entirety of the above-mentioned patent application is hereby incorporated by reference herein and made a part of this specification.

TECHNICAL FIELD

The disclosure relates to a shell and a wireless device using the same and more particularly, to a millimeter-wave (mmWave) antenna applying the shell.

BACKGROUND

Along with the rapid growth of wireless communication information services, people demand more and more about the communication quality. A next generation (i.e., the 5th generation mobile networks, also referred to as 5G) wireless communication technique has to satisfy operation requirements, such as high speed, high capacity and high quality. However, it is not easy to increase the frequency bandwidths. Because commonly used spectrums are already crowded enough, it is difficult to find big bands that are unused to satisfy the requirements for desired transmission speeds. Thus, it is essential for the section of bands with higher frequencies (>6 GHz). In order to meet the requirements and prospects for 5G in the future, current research organizations and major communication R&D manufacturers in the world all transfer from the originally used wireless micro wave bands (i.e., centimeter wave bands, e.g., bands of 2 GHz and 5 GHz) to higher millimeter-wave (mmWave) bands (>6 GHz). In these types of bands, as they are not overdeveloped, a single system bandwidth may be wider (for example, up to 500 MHz to 2 GHz), thereby effectively increasing data transmission capacity and system performance. Another advantage of the mmWave bands is short wavelengths and easy to be miniaturized for front end devices.

A shell or a device housing is a big challenge for mmWave communication applications. This is because the millimeter wave has a wavelength close to a shell thickness, which is likely to be influenced by the thickness and material of the shell to generate rebounds, causing issues, such as causing gain degeneration, side-lobe regrowth and electromagnetic interference. FIG. 1A through FIG. 1B are schematic diagrams illustrating an electromagnetic wave working between an array antenna 2 and a shell 1. FIG. 1A is a schematic diagram illustrating that the electromagnetic wave is orthogonally incident to the shell 1. FIG. 1B is a schematic diagram illustrating that the electromagnetic wave is obliquely incident to the shell 1. In scenarios that the electromagnetic wave is orthogonally radiated and is obliquely incident to the shell, a reflection phenomenon occurs in both of the scenarios in the presence of the shell (an insulation medium). It is mainly because when the electromagnetic wave transmit in different media, an impedance mismatching may likely occur between interfaces and cause a phenomenon of partial transmission and partial reflection. Such phenomenon may cause a loss of radiant energy, and a reflected signal may more likely travel arbitrarily inside a mobile device, such that an issue related to electromagnetic compatibility arises to cause malfunction to other electronic components. Thus, in order to reduce the waste in the radiation power or energy for being shielded by the shell, an adaptive design of the shell is a major subject, in particular, the applications in the mmWave bands or higher.

Regarding a shell made of an insulation material, in a low frequency (sub-6 GHz), since its thickness is far different from its wavelength, the issue that the electromagnetic wave shielded by the shell is less obvious in the past. However, when is speaks to an mmWave band (28-39 GHz), the electromagnetic wave may be shielded by the shell by up to 5 dB or more, which may cause a significant energy loss.

Basic theory of the field introduced as follows. FIG. 2 is a schematic diagram illustrating the electromagnetic wave transmitted among three medium materials. FIG. 2 illustrates scenarios that the electromagnetic wave is incident to the three types of medium materials, wherein two interfaces are included, on is between a first medium material and a second medium material, and the other is between the second medium material and a third medium material. An inherent impedance of the first medium material is $\eta_1$, an inherent impedance of the second medium material is 112, and an inherent impedance of the third medium material is $\eta_3$. d represents a thickness of the second medium material (i.e., a thickness of a shell of the disclosure). An input impedance $Z_2(0)$ from the first medium material to the second medium material may be expressed as $$Z_2(0) = \eta_2 \frac{\eta_3 \cos\beta_2 d + j\eta_3 \sin\beta_2 d}{\eta_2 \cos\beta_2 d + j\eta_2 \sin\beta_2 d} \tag{1}$$

In order for the interfaces to have no reflection, i.e., $\eta_1=Z_2(0)$, $\eta_1=\eta_3=Z_2(0)$, and thus, it is satisfied on the condition that $$\sin \beta_2 d=0 \tag{2}$$

Therefore, $$d = n\frac{\lambda_g}{2}(n = 1, 2, \ldots) \tag{3}$$

$\lambda g$ represents a wavelength of the electromagnetic wave in the second medium material. $\lambda g$ may be expressed as $$\lambda_g = \frac{c}{f\sqrt{\varepsilon_r}} \tag{4}$$

$\varepsilon_r$ represents a dielectric constant of the medium, c is a speed of light, and f is a frequency of the electromagnetic wave. Thus, if the thickness of the second medium material may be effectively controlled, an effect (e.g., an impedance mismatching) of the second medium material may be negligible.

In an mmWave band, as the millimeter wave has a wavelength close to the shell thickness, the medium material thereof may influence the effect of electromagnetic wave transmission. A method of the related art is to adjust the shell thickness, such that the thickness is made to be equal to an integer multiple of a half-wave length (e.g., the thickness of the shell 1 illustrated in FIG. 1A through FIG. 1B is adjusted to be $\alpha\lambda_g$). By effectively controlling the thickness of the second medium material, the influence on the electromagnetic wave from the shell may be negligible. However, the adjustment of the shell thickness may cause the shell to be thinner to damage the mechanical strength of the shell. According to formulas (3) and (4), besides adjusting the thickness, another major parameter that may be adjusted is the dielectric constant $\varepsilon_r$ (i.e., the dielectric constant of the second medium material). However, the dielectric constant is an attribute of the material itself, while it is not easy to replace the shell material.

SUMMARY

Accordingly, the disclosure provides a wireless device, including a shell configured with a low reflection structure and an array antenna disposed inside the shell. The low reflection structure is located within a radiation range of the array antenna after beam scanning. The low reflection structure includes a plurality of slots arranged periodically.

Several exemplary embodiments accompanied with figures described in detail below to further describe the disclosure in details.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF EMBODIMENTS

Figure 1A:
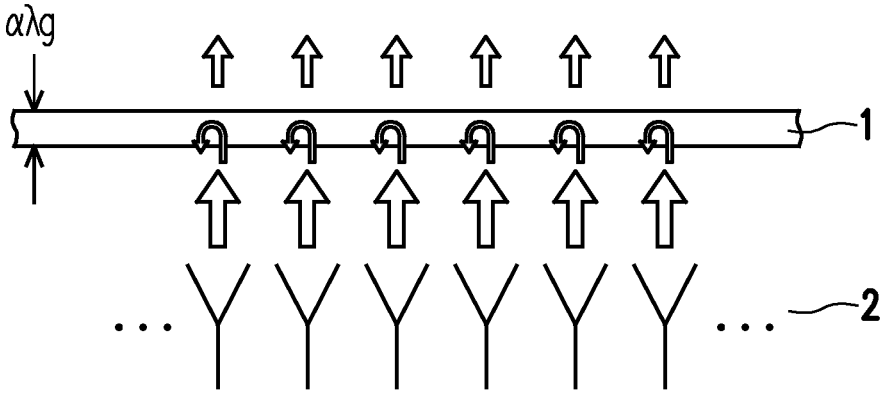
FIG. 1A through FIG. 1B are schematic diagrams illustrating an electromagnetic wave working between an array antenna and a shell.
Figure 1B:
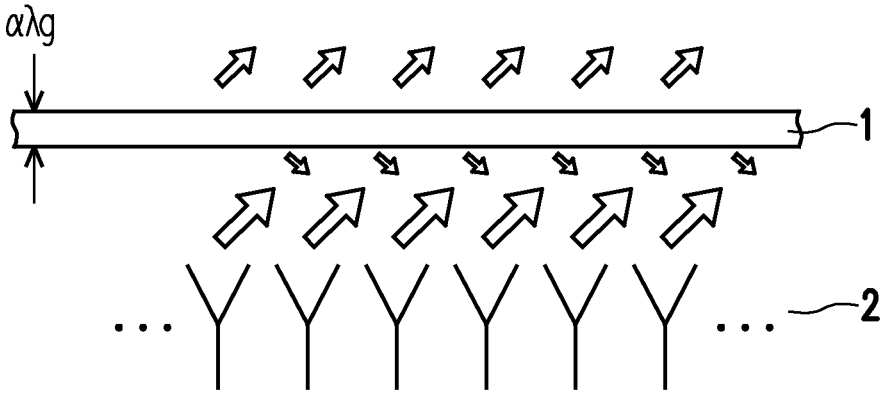
Figure 2:
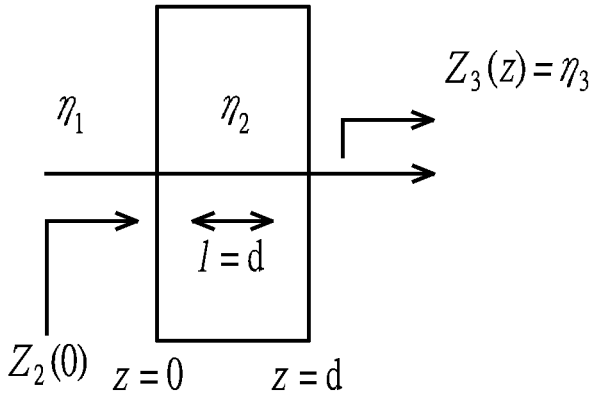
FIG. 2 is a schematic diagram illustrating the electromagnetic wave transmitted among three medium materials.

In the following embodiments, wordings used to indicate directions, such as "up," "down," "front," "back," "left," and "right", merely refer to directions in the accompanying drawings. Thus, the language is used for the directions, but not intended to limit the scope of the disclosure. In the accompanying drawings, the drawings illustrate the general features of the methods, structures, and/or materials used in the particular exemplary embodiments. However, these drawings should not be construed as defining or limiting the scope or nature of what is covered by these exemplary embodiments. For instance, the relative thicknesses and locations of various film layers, regions, and/or structures may be reduced or enlarged for clarity.

In the embodiments, the same or similar elements will be designated by the same or similar reference numerals, and descriptions thereof will be omitted. In addition, the features of different exemplary embodiments may be combined with each other when they are not in conflict, and simple equivalent changes and modifications made according to the specification or the claims are still within the scope of the disclosure. Additionally, terms such as "first" and "second" mentioned throughout the specification or the claims of this application are only for naming the names of the elements or distinguishing different embodiments or scopes and are not intended to limit the upper limit or the lower limit of the number of the elements nor intended to limit manufacturing sequences or disposition sequences of the elements.

Figure 3A:
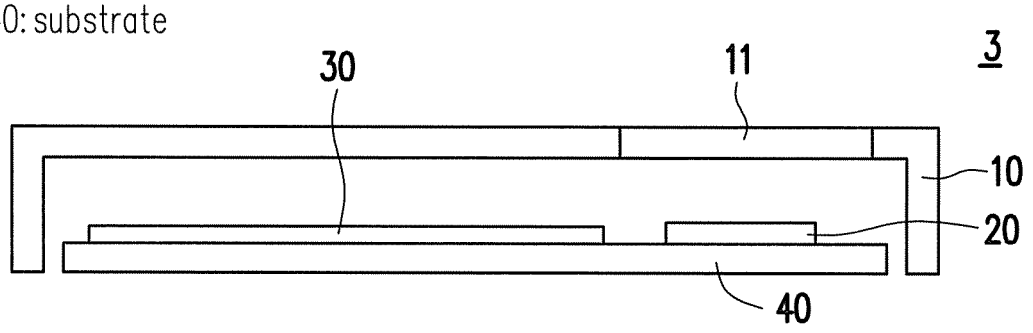
FIG. 3A through FIG. 3D are diagrams illustrating relative locations of an array antenna and a shell configured with a low reflection structure in the disclosure.
Figure 3B:
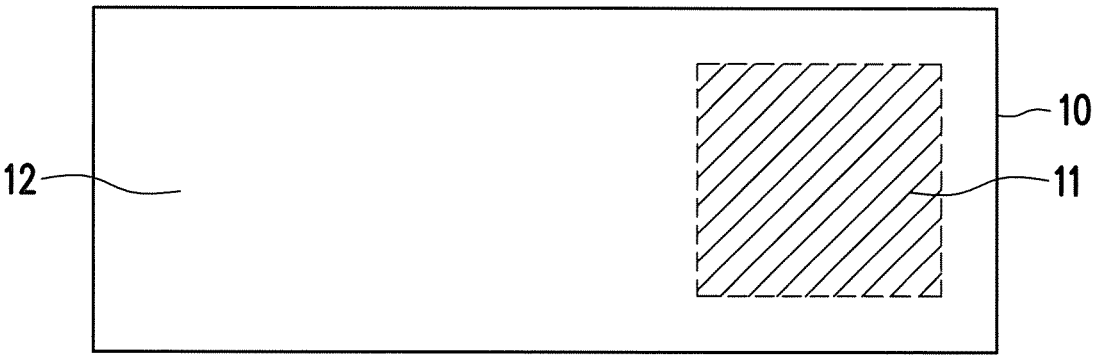
Figure 3C:
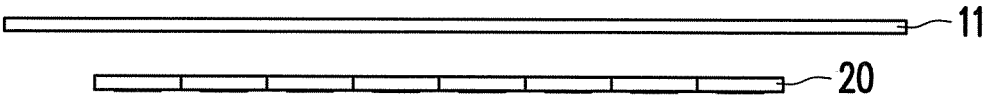
Figure 3D:
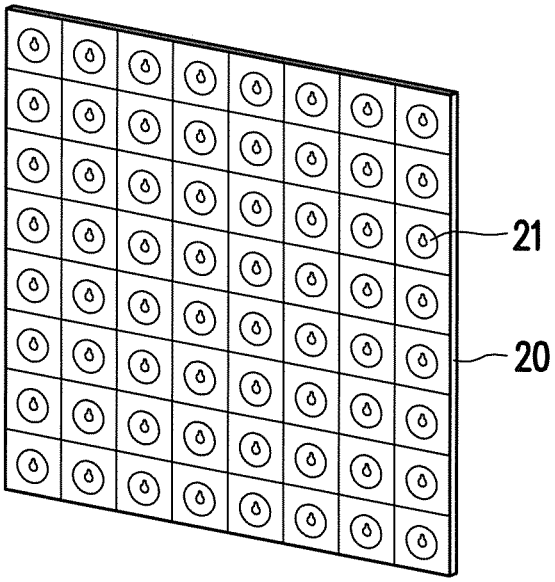

FIG. 3A through FIG. 3D are diagrams illustrating relative locations of an array antenna and a shell configured with a low reflection structure in the disclosure. FIG. 3A illustrates a wireless device 3 of the disclosure. The wireless device 3 includes a shell 10 configured with a low reflection structure 11. The shell 10 is disposed above an array antenna 20. The array antenna 20 and an electronic component 30 are disposed on a substrate 40. FIG. 3B is a top view of the shell 10. The shell 10 is disposed with the low reflection structure 11 and a non-low reflection structure 12. FIG. 3C illustrates that the low reflection structure 11 is located within a radiation range of the array antenna 20 after beam scanning, wherein the low reflection structure includes a plurality of slots arranged periodically. The slots are a plurality of removed holes capable of penetrating or not penetrating the low reflection structure 11. Referring to FIG. 3C, an electromagnetic wave radiated by the array antenna 20 can transmit through a second medium material from a first medium material and then transport in a third medium material. In the disclosure, the first medium material and the third medium material are air, and the second medium material is a medium material of the shell 10. FIG. 3D illustrates an embodiment of the array antenna 20 of the disclosure. The array antenna 20 may be a multi-antenna array having a plurality of antenna units 21, for example, a 39 GHz 8-by-8 mmWave array, but the disclosure is not limited thereto. A scannable range of the beam scanning by the array antenna 20 is at least ±60 degrees.

Figure 4A:
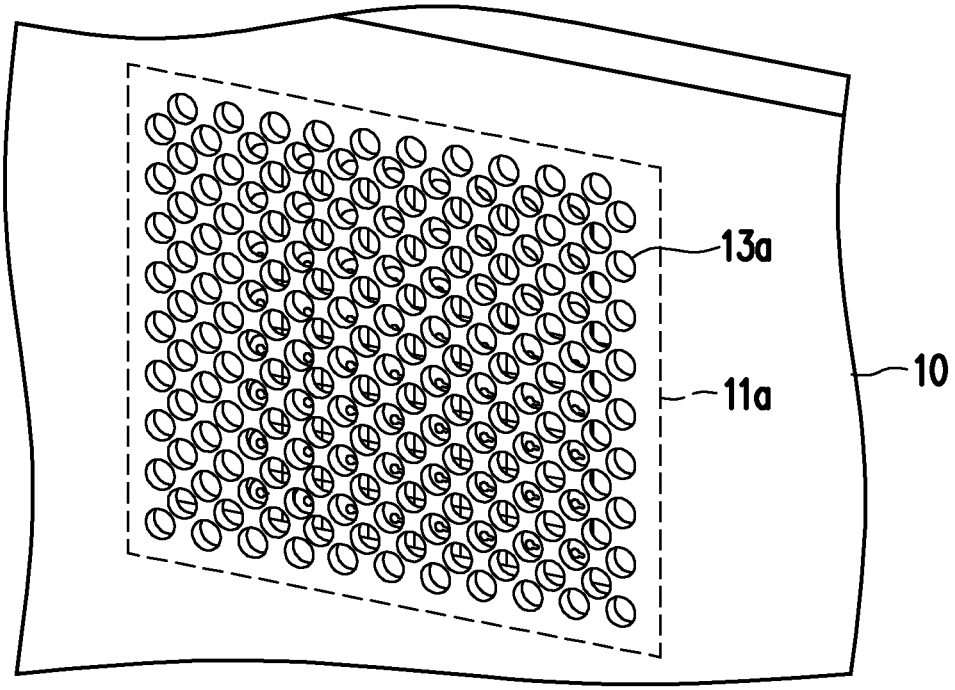
FIG. 4A through FIG. 4C are structure diagrams illustrating a low reflection structure disposed on a medium shell in an embodiment of the disclosure.
Figure 4B:
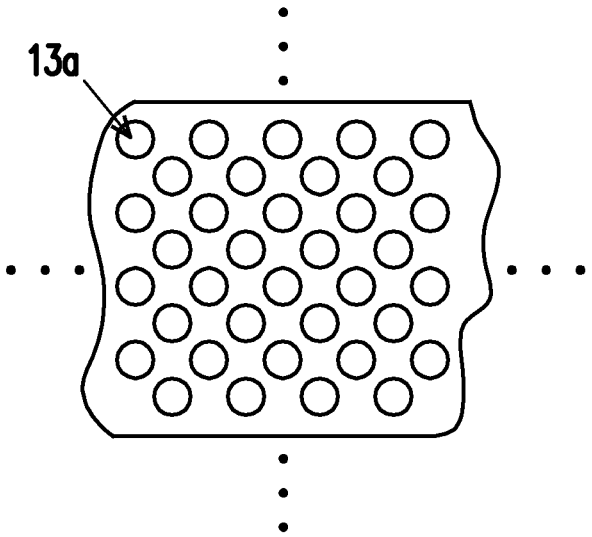
Figure 4C:
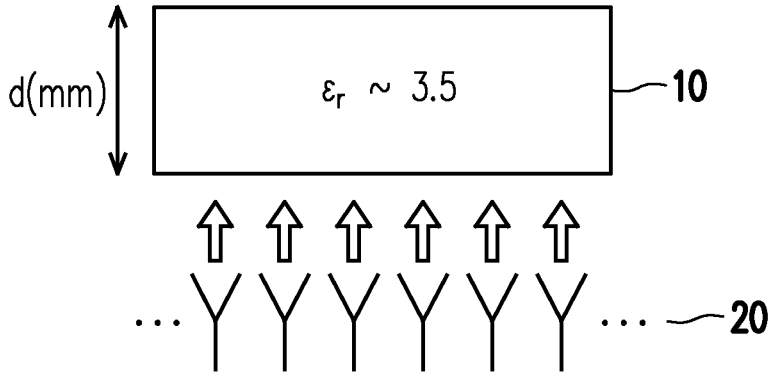

FIG. 4A through FIG. 4C are structure diagrams illustrating a low reflection structure disposed on a medium shell in an embodiment of the disclosure. Referring to FIG. 3A through FIG. 3D simultaneously, FIG. 4A illustrates that the shell 10 configured with a low reflection structure 11*a*. The array antenna 20 is disposed inside the shell 10 (as illustrated in FIG. 4A, the shell 10 may completely cover the array antenna 20). The low reflection structure 11*a* is located within the radiation range of the array antenna 20 after the beam scanning, and the array antenna 20 is disposed within a vertical projection range of the low reflection structure 11*a*. The low reflection structure 11*a* includes a plurality of slots 13*a* arranged periodically. The slots 13*a* are holes that are removed to penetrate the shell 10 (FIG. 4B).

Referring to FIG. 4B, a shape of the slots 13*a* is a circular shape, but the disclosure is not limited thereto. In other embodiments, the shape of the slots 13*a* may be a square shape or a polygonal shape. The slots 13*a* may be filled with a dielectric material or air. In a preferred embodiment, the slots 13*a* may be filled with air, but the disclosure is not limited thereto. A radius size and a period of the slots 13*a* are changeable. An equivalent dielectric constant of the low reflection structure 11*a* inside the shell 10 can be adjusted by changing the radius size and the period of the slots 13*a*. In an embodiment, the period of the slots 13*a* is 0.5λ, and the radius size is ⅛λ, to ⅓λ, but the disclosure is not limited thereto. λ represents an electromagnetic wavelength of the array antenna 20 radiated in a medium.

Referring to FIG. 4C, a material of the medium shell in the present embodiment is an insulation material, for example, a pliable material (with $\varepsilon_r$ about 3.5), such as an ordinary plastic material, a resin or the like. The shell 10 has a thickness d. In a condition the shell does not have the slots arranged periodically, a reflection loss of the array antenna 20 may be the minimum when the thickness d is 2.3 mm, and the reflection loss of the array antenna 20 may be the maximum when the thickness d is 1.2 mm. However, in the embodiments of the disclosure, in a condition that the shell has the slots arranged periodically, the reflection loss of the array antenna 20 is the minimum when the thickness d is 1.2 mm. Furthermore, adaptively adjusting the radius size and the period of the slots according to the thickness of the shell 10 in the present embodiment can adjust the equivalent dielectric constant of the low reflection structure 11*a* inside the shell 10. Filling the slots 13*a* with the dielectric material or air can adjust the equivalent dielectric constant of the low reflection structure 11*a* inside the shell 10.

Figure 5:
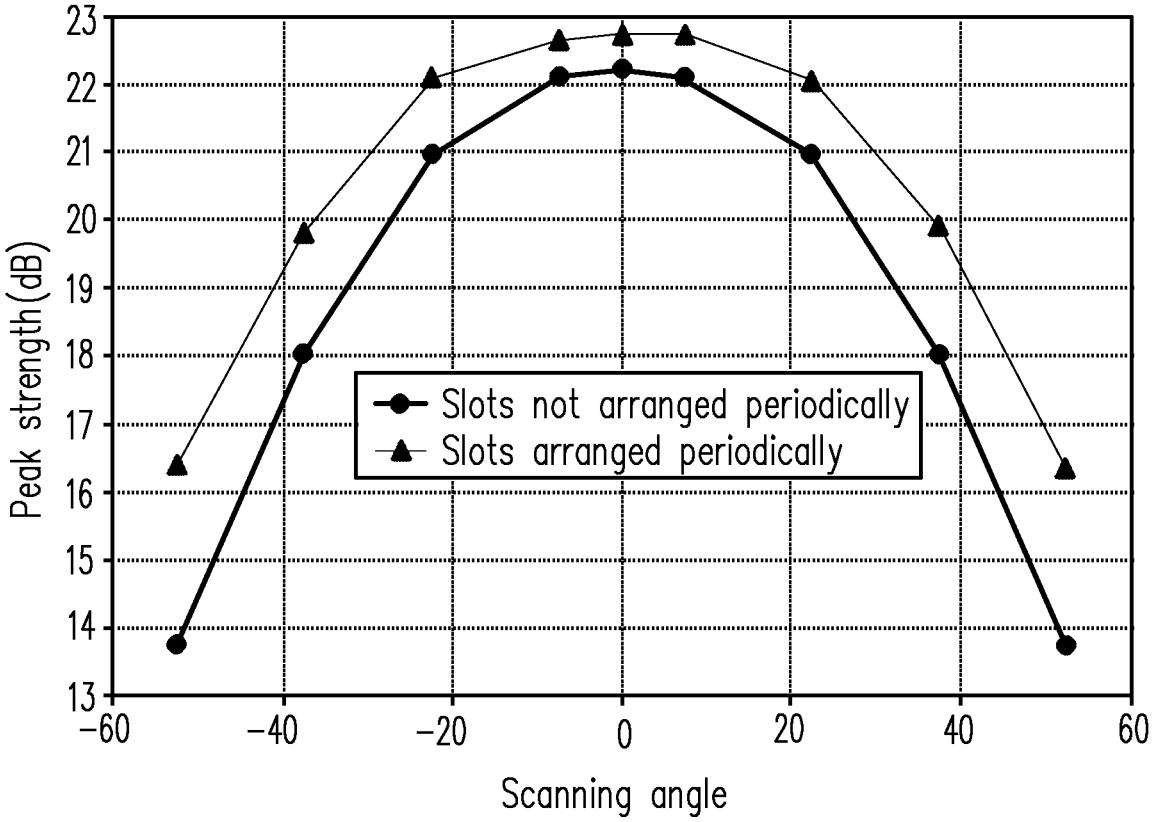
FIG. 5 is a diagram illustrating a relation between a peak strength corresponding to the radiation generated by the array antenna through the shell configured with the low reflection structure depicted in FIG. 4A through FIG. 4C and a scanning angle in an embodiment of the disclosure.

FIG. 5 is a diagram illustrating a relation between a peak strength corresponding to the radiation generated by the array antenna through the shell configured with the low reflection structure depicted in FIG. 4A through FIG. 4C and a scanning angle in an embodiment of the disclosure. FIG. 5 exhibits that during the beamforming of the array antenna 20 in the beam scanning, the shell configured with the slots arranged periodically, compared with the shell without the slots arranged periodically, may achieve effectively enhancing a peak gain and reducing the reflection loss. Especially, in a scenario of scanning in a large angle range (e.g., close to ±55 degrees), the shell with the slots arranged periodically may achieve enhancing the peak gain by about 3 dB.

Accordingly, in the present embodiment, with the low reflection structure 11*a* disposed on the medium shell, the equivalent dielectric constant of the low reflection structure 11*a* may be adjusted, and the reflection loss of the array antenna 20 may be effectively reduced, so as to enhance the radiation efficiency of the array antenna 20. In comparison with the shell without the slots arranged periodically, the shell with the slots arranged periodically can effectively reduce the reflection loss of the array antenna 20. The wireless device of the present embodiment is not limited by the shell thickness. Adaptively adjusting the radius size and the period of the slots 13*a* according to the thickness of the shell 10, and filling the slots 13*a* with the dielectric material or air to adjust the equivalent dielectric constant of the low reflection structure 11*a* on the shell 10 can further reduce the reflection loss of the array antenna 20*d*. On the other hand, filling the dielectric material in the slots 13*a* may also achieve an airtight seal effect for the shell.

Figure 6:
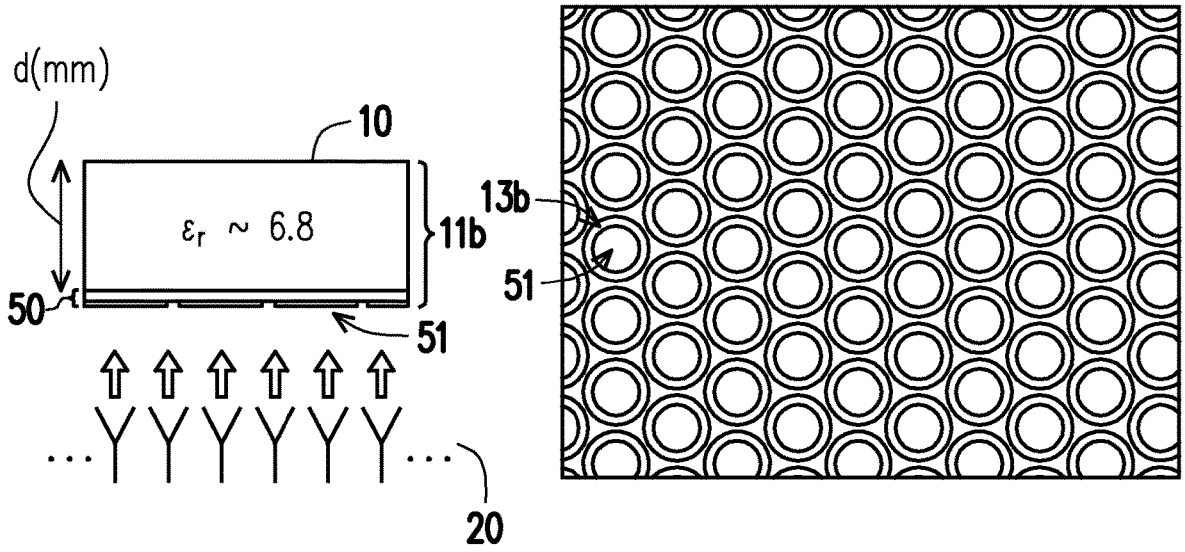
FIG. 6 is a structure diagram illustrating a low reflection structure having a low reflection layer in an embodiment of the disclosure.

On some shell materials, for example, glass, it is not easy to perform physically structural change, for example, drilling of the slots arranged periodically, thereon. Thus, the disclosure proposes another method to improve the electromagnetic wave reflection caused by the shell. In another embodiment of the disclosure, FIG. 6 is a structure diagram illustrating a low reflection structure having a low reflection layer in an embodiment of the disclosure. The shell 10A illustrated in FIG. 6 includes a low reflection structure 11*b* and a low reflection layer 50. A surface of the low reflection layer 50 includes a plurality of slots 13*b* arranged periodically, and the plurality of slots 13*b* are disposed in a metal layer 51 on the surface of the low reflection layer 50. The slots 13*b* are a plurality of holes that do not penetrate the low reflection structure 11*b*. In an embodiment, a material of the shell 10 is glass (with $\varepsilon_r$ about 6.8). The shell 10 has a thickness d. In the condition the shell does not have the slots arranged periodically, the reflection loss of the array antenna 20 may be the minimum when the thickness d is 1.5 mm, and the reflection loss of the array antenna 20 may be the maximum when the thickness d is 0.8 mm. However, in the disclosure, in a condition that the low reflection layer 50 has the slots arranged periodically, the low reflection structure 11*b* may contribute to the minimum reflection loss of the array antenna 20 when the thickness d is 0.8 mm.

Accordingly, the shell 10, made by glass, additionally configured with the low reflection layer 50 may contribute to reducing the reflection of the electromagnetic wave between the glass and the air. The low reflection layer 50 may be a printed circuit board or a flexible board. In an embodiment, the low reflection layer 50 is a flexible board made to be a screen-printed structure by printing the structure of the slots arranged periodically on the metal layer 51 on the surface of the flexible board through a flexible printed circuit (FPC) process. In the present embodiment, a shape of the slots 13*b* arranged periodically is a ring shape, but the disclosure is not limited thereto. In other embodiments, the shape of the slots 13*b* arranged periodically may be a circular shape, a polygonal shape, a polygonal ring shape or a cross shape, which is not limited in the disclosure. The flexible board has flexibility and thus, compared with a general type printed circuit board, has an advantage in the capability of being attached to the glass shell.

Figure 7:
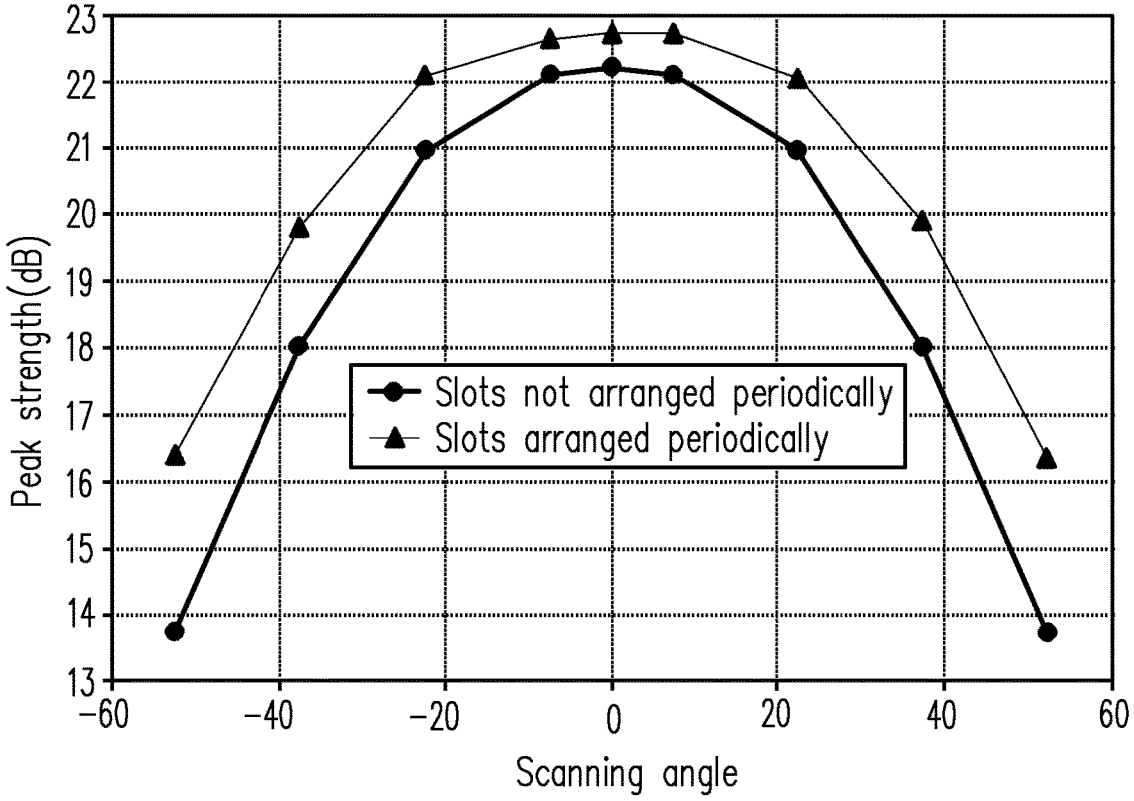
FIG. 7 is a diagram illustrating a relation between a peak strength corresponding to the radiation generated by the array antenna through the shell configured with the low reflection structure depicted in FIG. 6 and a scanning angle in an embodiment of the disclosure.

FIG. 7 is a diagram illustrating a relation between a peak strength corresponding to the radiation generated by the array antenna through the shell configured with the low reflection structure depicted in FIG. 6 and a scanning angle in an embodiment of the disclosure. FIG. 7 exhibits that during the beam forming of the array antenna 20 in the beam scanning, the glass shell configured with the low reflection layer having the slots arranged periodically may achieve effectively enhancing the peak gain and reduce the reflection loss in comparison with the glass shell without the low reflection layer. Especially, in a scenario of scanning in a large angle range, the glass shell configured with the low reflection layer may achieve enhancing the peak gain by about 3 dB. Because it is unnecessary to drill the slots arranged periodically on the glass shell, result in reducing mechanical loss caused by the manufacturing of the shell.

Accordingly, in the present embodiment, the low reflection structure 11*b* is configured with the low reflection layer, thereby adjusting the equivalent dielectric constant of the low reflection structure 11*a* and effectively reducing the reflection loss of the array antenna 20, so as to enhance the radiation efficiency of the array antenna 20. In comparison with the shell without the slots arranged periodically, the shell with the slots arranged periodically and do not penetrate the shell may achieve effectively reducing the reflection loss of the array antenna 20. The wireless device of the present embodiment may not limited by the shell thickness and further reduces the reflection loss of the array antenna 20.

Figure 8B:
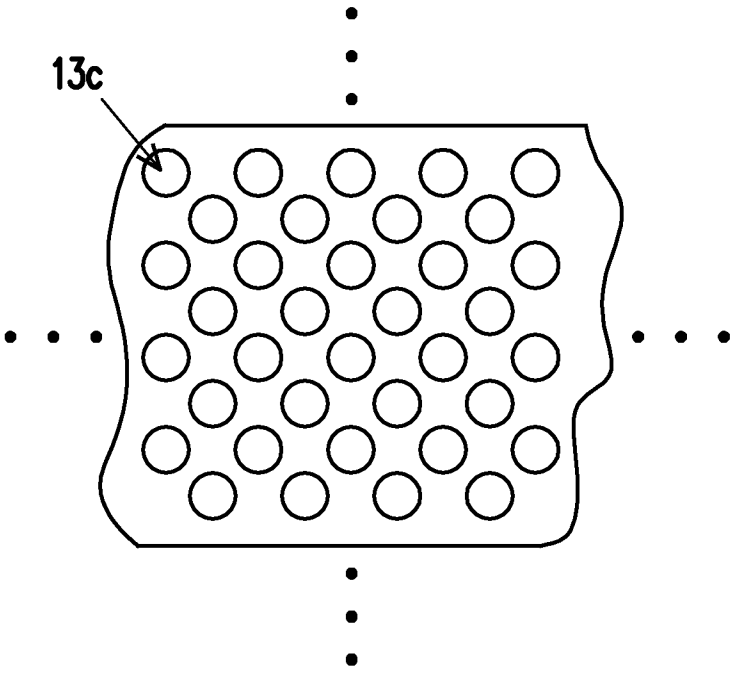
FIG. 8A through FIG. 8B are structure diagrams illustrating a low reflection structure disposed on a metal shell in an embodiment of the disclosure.
Figure 8A:
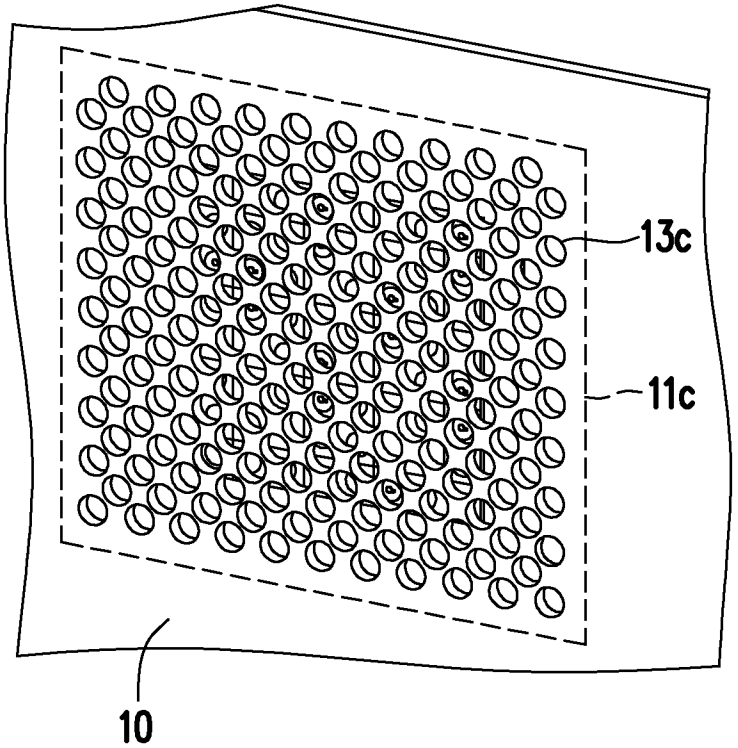

In some embodiments, in case the shell made of, for example, a metal material, the electromagnetic wave is shielded and difficult to penetrate to the outside especially when the wireless device operates in a low frequency band (e.g., a millimeter-wave (mmWave) band). FIG. 8A through FIG. 8B are structure diagrams illustrating a low reflection structure disposed on a metal shell in an embodiment of the disclosure. FIG. 8A illustrates that the shell 10 is configured with a low reflection structure 11*c*, and the array antenna 20 is disposed inside the shell 10 (as illustrated in FIG. 8A, the shell 10 may completely cover the array antenna 20). The low reflection structure 11*c* is located within the radiation range of the array antenna 20 after beam scanning, and the array antenna 20 is disposed within a vertical projection range of the low reflection structure 11*c*. The low reflection structure 11*c* includes a plurality of slots 13*c* arranged periodically. The slots 13*c* are holes that are removed to penetrate the shell 10 (FIG. 8B).

Referring to FIG. 8B, in the present embodiment, a shape of the slots 13*c* is a circular shape, but the disclosure is not limited thereto. In other embodiments, the shape of the slots 13*c* may be a square shape or a polygonal shape, but the disclosure is not limited thereto. The slots 13*c* may be hollow or filled with a dielectric material to increase air-tightness. In a preferred embodiment, the dielectric material filled in the slots 13*c* is one having a dielectric constant of 3.5, but the disclosure is not limited thereto. A radius size and a period of the slots 13*c* are changeable. An equivalent dielectric constant of the low reflection structure 11*c* inside the shell 10 may be adjusted by changing the radius size and the period of the slots 13*c*. In some embodiments, the period of the slots 13*a* is 0.5λ, to 0.6λ, and the radius size is ⅛λ, to ½λ, wherein λ represents a wavelength of the electromagnetic wave of the array antenna 20 radiated in the medium (which is the metal in the present embodiment).

Figure 9:
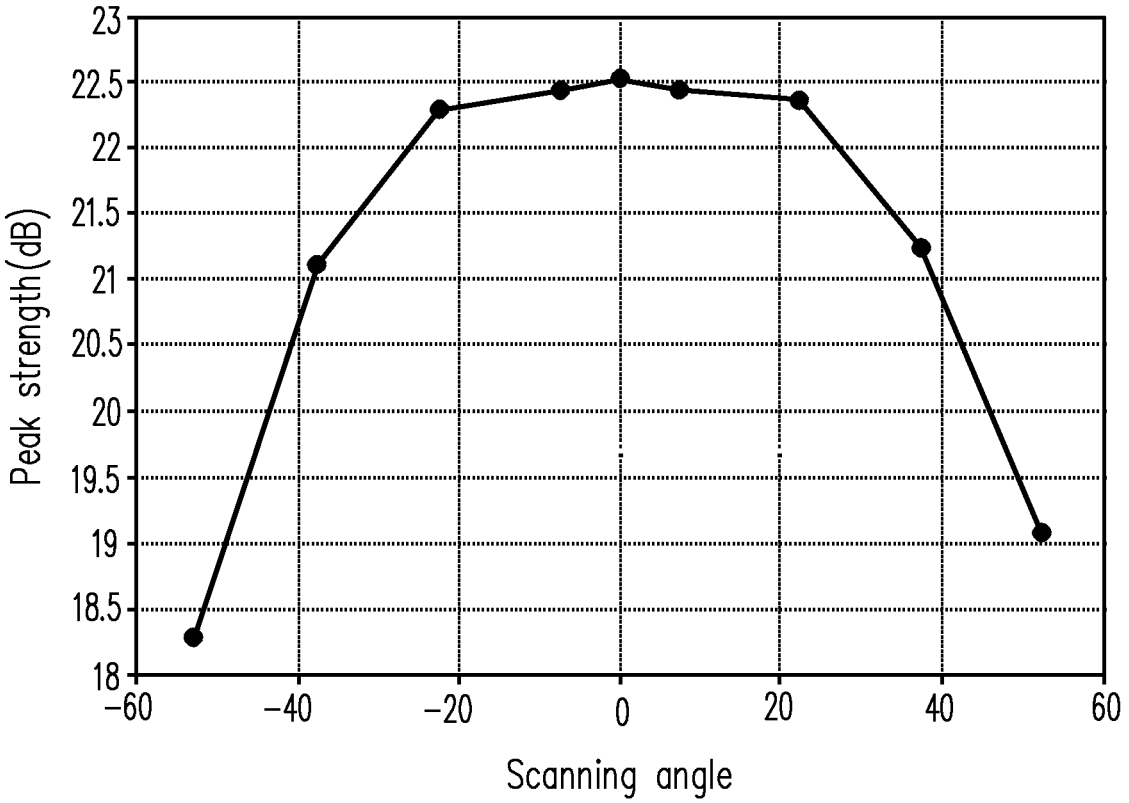
FIG. 9 is a diagram illustrating a relation between a peak strength corresponding to the radiation generated by the array antenna through the shell configured with the low reflection structure depicted in FIG. 8A through FIG. 8B and a scanning angle in an embodiment of the disclosure.

FIG. 9 is a diagram illustrating a relation between a peak strength corresponding to the radiation generated by the array antenna through the shell configured with the low reflection structure depicted in FIG. 8A through FIG. 8B and a scanning angle in an embodiment of the disclosure. It may be evident according to FIG. 9 that the electromagnetic wave effectively transmit through the metal shell, without shielded by the metal shell.

Accordingly, in the present embodiment, the low reflection structure 11*c* disposed in the metal shell is used to adjust the equivalent dielectric constant of the low reflection structure 11 to effectively reduce the reflection loss of the array antenna 20, such that the electromagnetic wave can effectively transmit through the metal shell, thereby enhancing the radiation efficiency of the array antenna 20.

In light of the foregoing, in comparison with the shell without the slots arranged periodically, the wireless device of the disclosure disposed with the shell configured with the slots, which is arranged periodically with penetrating the shell or not, can adjust the dielectric constant of the low reflection structure inside the shell as the equivalent dielectric constant to effectively reduce the reflection loss of the array antenna. The wireless device of the disclosure may also be not limited by the shell thickness and adaptively adjust the radius size and the period of the slots according to the thickness of the shell and filling the slots with the dielectric material or the air, such that the equivalent dielectric constant of the low reflection structure can be adjusted to further effectively reduce the reflection loss. As such, the attenuation caused by the shell itself to the radiation signals can be reduced, as well as the peak gain of the radiation of the array antenna can be effectively enhanced, and especially, in the scenario of scanning in a large angle range, the shell with the slots arranged periodically may achieve enhancing the peak gain by about 3 dB.

Furthermore, regarding the communication application of the mmWave antenna, reducing the shell thickness in order to reduce the reflection loss in the method of the related art results in mechanical loss of the shell. Nevertheless, the shell having the slots arranged periodically introduced by the disclosure can achieve the reduction of the reflection loss without changing the shell thickness. The design of the low reflection structure of the shell of the wireless device of the disclosure can effectively reduce the reflection loss of the mmWave array antenna caused by the shell, thereby enhancing the radiation efficiency of the array antenna and reducing the power consumption.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A wireless device, comprising:

a shell, configured with a low reflection structure; and an array antenna, disposed inside the shell, wherein the low reflection structure is located within a radiation range of the array antenna after beam scanning, and the low reflection structure comprises a plurality of slots arranged periodically, wherein a dielectric constant of the low reflection structure is adjusted as an equivalent dielectric constant by adjusting at least one of a radius size and a period of the slots so as to reduce a reflection loss of the array antenna without adjusting a thickness of the shell.

2. The wireless device according to claim 1, wherein the array antenna is a millimeter-wave (mmWave) array antenna.

3. The wireless device according to claim 1, wherein the array antenna is disposed within a vertical projection range of the low reflection structure.

4. The wireless device according to claim 1, wherein the shell has a thickness and a part of the shell is the low reflection structure.

5. The wireless device according to claim 1, wherein a shape of the slots is a circular shape, a square shape or a polygonal shape.

6. The wireless device according to claim 1, wherein the shell is made of a metal or an insulation material.

7. The wireless device according to claim 1, wherein the slots are filled with a dielectric material or air.

8. The wireless device according to claim 1, wherein the shell is made of glass, the low reflection structure comprises a low reflection layer, the low reflection layer comprises the plurality of slots arranged periodically, and the plurality of slots are disposed in a metal layer on a surface of the low reflection layer.

9. The wireless device according to claim 8, wherein a shape of the plurality of slots is a ring shape, a circular shape, a polygonal shape, a polygonal ring shape or a cross shape.

10. The wireless device according to claim 8, wherein the low reflection layer is a printed circuit board or a flexible board, and the flexible board comprises a screen-printed structure.

11. The wireless device according to claim wherein the slots are a plurality of removed holes capable of penetrating or not penetrating the low reflection structure.

* * * * *